United States Patent [19]

Kentosh

[11] Patent Number: 4,654,015

[45] Date of Patent: Mar. 31, 1987

[54] MOORING INSTALLATION

[75] Inventor: James M. Kentosh, Los Angeles, Calif.

[73] Assignee: Amtel, Inc., Providence, R.I.

[21] Appl. No.: 183,110

[22] Filed: Sep. 2, 1980

Related U.S. Application Data

[63] Continuation-in-part of Ser. No. 24,609, Mar. 28, 1979, Pat. No. 4,254,523.

[51] Int. Cl.[4] ..... B63B 22/02

[52] U.S. Cl. ..... 441/5; 114/230

[58] Field of Search ..... 114/230; 441/3, 4, 5

[56] References Cited

U.S. PATENT DOCUMENTS

| | | | |
|---|---|---|---|
| 3,155,069 | 11/1964 | Ross et al. | 9/8 P X |
| 3,335,690 | 8/1967 | Busking | 9/8 P X |
| 3,440,671 | 4/1969 | Smulders | 9/8 P |
| 3,442,245 | 5/1969 | Christians et al. | 9/8 P X |
| 3,481,294 | 12/1969 | Vincent | 9/8 P X |
| 3,783,816 | 1/1974 | Chassy et al. | 114/230 |
| 3,913,157 | 10/1975 | Versluis et al. | 9/8 P |
| 4,031,582 | 6/1977 | Heijst | 9/8 P |
| 4,098,212 | 7/1978 | Kemper et al. | 9 P/8 X |
| 4,130,077 | 12/1978 | Person et al. | 9/8 P X |
| 4,176,615 | 12/1979 | Reid | 114/230 |

FOREIGN PATENT DOCUMENTS

| | | | |
|---|---|---|---|
| 1055129 | 1/1967 | United Kingdom | 441/4 |

*Primary Examiner*—George E. A. Halvosa

*Attorney, Agent, or Firm*—Freilich, Hornbaker, Rosen & Fernandez

[57] ABSTRACT

An offshore terminal of the type which includes a dedicated vessel which rigidly supports a transfer structure beyond one end of the vessel, and with the transfer structure held by catenary chains to the sea floor. The transfer structure lies very close to an end of the vessel, but is has an underwater lower end which lies at a level substantially no higher than the adjacent end of the vessel, to avoid the possibility of the catenary chains hitting the vessel. The transfer structure extends from below water to above water, and the hose structure extending up from the sea floor extends through the transfer structure to protect it from surface waves. A product distribution unit (PDU) lies at the top of the transfer structure and has a turning portion connected to the vessel, the PDU being connected to the vessel independently of a massive mooring structure that connects a rotatable portion of the transfer structure to the vessel to transfer large loads. The heavy duty mooring structure includes upper and lower plates with inner ends which are curved to mate with the extreme end of the vessel and which are attached thereto.

1 Claim, 5 Drawing Figures

FIG. 1
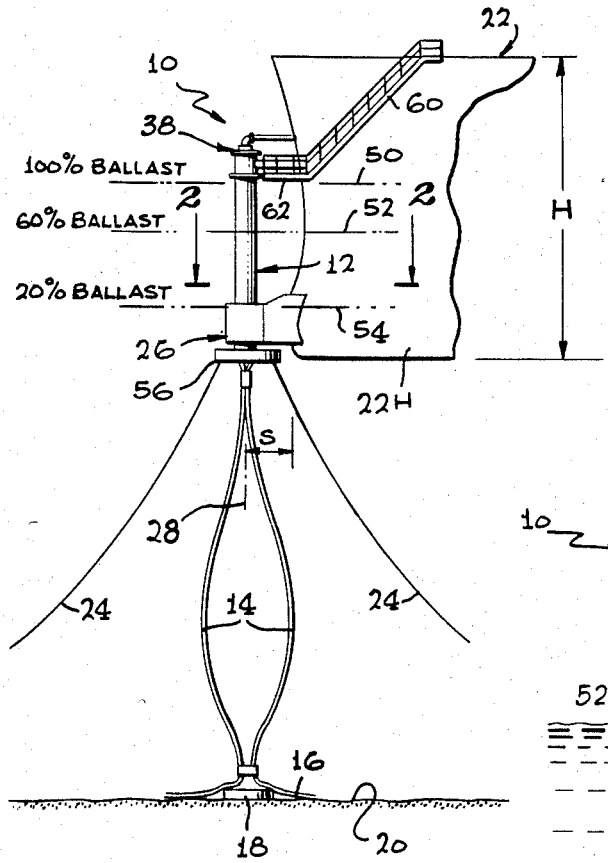
FIG. 3
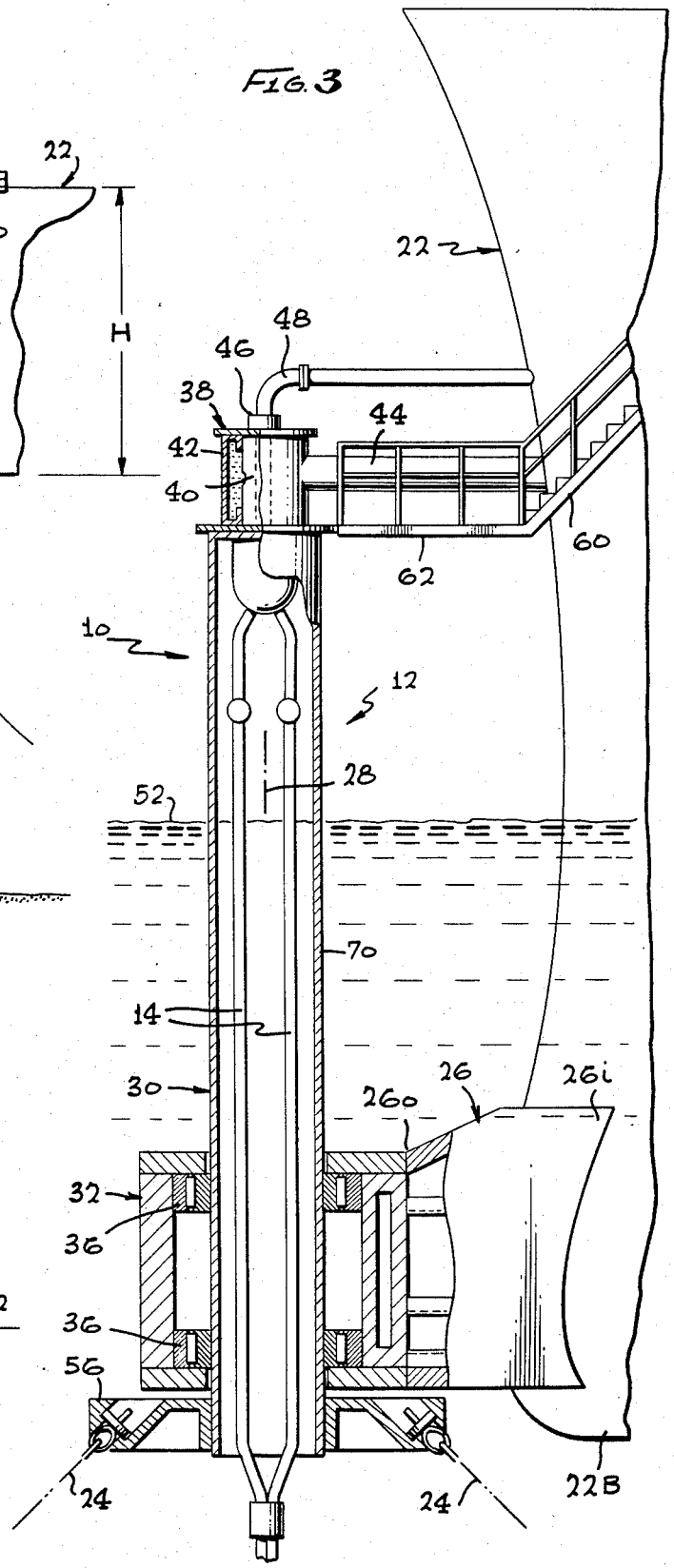
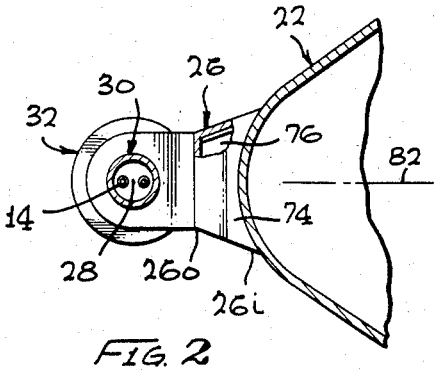
FIG. 2

MOORING INSTALLATION

BACKGROUND OF THE INVENTION

Oil or other fluid cargo can be transferred between an undersea pipeline and a vessel, through a single point mooring terminal that includes a buoy floating at the surface of the sea and anchored in place by several catenary chains. The buoy serves as a transfer structure, and is coupled by a hose or pipe to the undersea pipeline and by another hose or pipe to a floating vessel. In some applications, it has been found useful to permanently moor a storage vessel to the buoy. A variety of mooring structures have been utilized to connect the buoy, or transfer structure, to a permanently moored vessel. One type of mooring terminal, such as that shown in U.S. Pat. No. 3,335,690 by Busking, utilizes a beam rigidly fixed to the vessel and to a rotatable portion of the transfer structure. In this type of terminal, the buoyancy of the vessel supports the transfer structure, and a nonrotatable portion of the transfer structure holds the vessel in approximate location by means of chains that exend from the transfer structure to the sea floor. The transfer structure can lie out of the water to facilitate access to a swivel unit, or product distribution unit (PDU), on the transfer structure, which is a device that typically requires maintenance, to facilitate such maintenance. However, as is pointed out in "The Advantages of the Single Buoy Storage System (SBS)" by Sagot and Van Heijst in a paper given at the fifth annual Offshore Technology Conference held in Houston, Tex. Apr. 29–May 2, 1973, there are several disadvantages in this rigid mooring approach. These disadvantages include the fact that the transfer structure is subject to high pitch motions and the hose that extends down to the sea base is subjected to wave motions that can damage it. Also, the beam which holds the transfer structure must be very strong in order to hold the transfer structure a considerable distance away from the vessel to avoid the chains hitting the vessel. A mooring installation of the type which utilized a transfer structure rigidly connected to an end of a vessel, but which avoided many of the disadvantages of prior art installations of this type, would be of considerable value.

SUMMARY OF THE INVENTION

In accordance with one embodiment of the present invention, an offshore terminal is provided, of the type which includes a dedicated vessel substantially fixed to a transfer structure located at or near the sea surface and anchored to the sea floor, which provides high reliability and ruggedness while utilizing an economy of structure. A mooring beam structure holds the transfer structure close to an end of the vessel to minimize pitching forces that must be transmitted from the vessel to the transfer structure. A transfer structure held to the sea floor by lines such as catenary chains, has a lower end located at an underwater depth which is at least about the same as the adjacent end of the vessel, to avoid the possibility that the catenary chains will hit the vessel. The transfer structure extends from the underwater lower end to an upper end which is above the water line, and which is hollow to receive the pipe and hose structure that extends upwardly from the seabed, to protect the hose structure from surface waves. A swivel unit or product distribution unit (PDU) lies at the top of the transfer structure, and is separately rotatably mounted on the transfer structure and separately connected to the vessel to rotate with it, to avoid the transmittal of large mooring forces through the PDU or the pipes that connect it to the vessel. The mooring structure can include a wide and tall box beam having upper and lower plates that have ends formed in curves that mate with the extreme end of the vessel to fit closely thereabout for joining thereto.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial side elevation view of an offshore terminal system constructed in accordance with the present invention.

FIG. 2 is a view taken on the line 2—2 of FIG. 1.

FIG. 3 is a partially sectional view of a portion of the system of FIG. 1.

DESCRIPTION OF THE PREFERRED EMBODIMENTS

Figure 4:
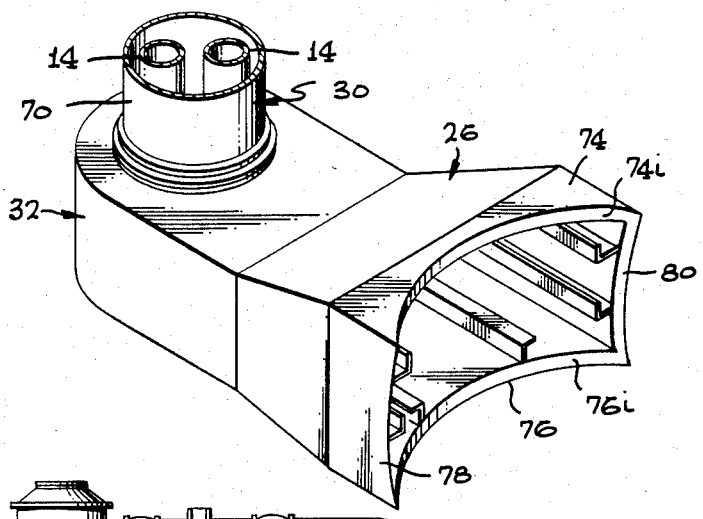
FIG. 4 is a partial perspective view of a portion of the system of FIG. 3.

FIG. 1 illustrates an offshore terminal system 10 of a type which includes a transfer structure 12 which lies at the surface of the sea and is connected by an underwater flexible conduit 14 such as a hose structure to at least one pipeline 16 near the sea floor 20. The pipeline 16, which is tied to a base 18 lying at the sea floor may, for example, extend to a hydrocarbon well from which oil is received for delivery by way of a conduit that includes the hose structure 14 through the transfer structure 12 to a vessel 22. The vessel 22 is a dedicated vessel for storage of the oil or other cargo, until it can be transferred to a tanker. A group of lines 24 which may be loose or catenary chains, serve as anchor means to hold the transfer structure 12 from drifting far from a position over the base 18, while permitting some vertical and horizontal movement. The vessel 22 is a seaworthy structure, such as a tanker or barge, that includes a buoyant elongated hull 22H having bow and stern ends, and which can be towed or self-propelled to the installation and there withstand heavy seas. The bow of the vessel is convex, as seen in a plan view such as FIG. 2, to encounter waves in a seaworthy manner. A mooring structure 26 is provided to substantially permanently connect the vessel 22 to the transfer structure 12, to keep them close together but without hitting each other during violent storms. The transfer structure 12 is constructed to permit the vessel to drift about a vertical axis 28 at the center of the installation under the influence of currents, winds, and waves.

As is also shown in FIG. 3, the transfer structure 12 includes a nonrotatable portion or frame 30 that is anchored through the catenary lines 24 to the sea floor, and also includes a rotatable portion or frame 32 that can rotate without limit about the vertical axis 28 together with the vessel 22. The largely nonrotatable frame 30 can turn to some extent, but is prevented from unlimited rotation about a vertical axis by the catenary lines 24. The rotatable frame 32 is fixed to the mooring structure 26 to move and rotate with the vessel, and is rotatably coupled through bearings 36 to the nonrotatable or stationary frame 30 of the transfer structure. In addition, a fluid swivel unit or product distribution unit (PDU) 38 is provided which has a stationary portion 40 fixed to the nonrotatable frame 30, and a turning portion 42 which rotates about the vertical axis 28 and which is coupled to the hose structure 14 that extends down to the sea floor and also to a pipe 44 that extends to the vessel. The PDU 38 is of a type that can separately transfer two fluids, and includes another joint at 46 that separately rotatably connects a pipe 48 to the vessel.

The mooring structure 26 has an inner end **26*i* fixed to the vessel and an outer end 26*o* fixed to the rotatable portion 32 of the transfer structure, so that the mooring structure prevents free pivoting of the transfer structure about a horizontal axis with respect to the vessel. The bearings 36 prevent relative vertical movement of the transfer structure portions 30, 32. As a result, the vessel 22 supplies the buoyancy required to hold the transfer structure 12 together with the weight of the chains 24 thereon, at the sea surface and with its rotation axis 28 in a largely vertical orientation, while the transfer structure 12 holds the vessel 22 from drifting far away from a position over the sea floor base 18. It can be appreciated that the rigid connection provided by the mooring structure 26 can result in considerable vertical movement of the transfer structure 12 during pitching of the vessel 22 in rough seas. However, the flexible connection of the transfer structure to the sea bottom through the lines 24 and the hose structure 14, permits such movement. The vessel 22 is much larger than the transfer structure 12, since a typical use of the vessel is to store large quantities of oil or other cargo while awaiting arrival of a tanker, and the vessel is typically highly buoyant. Accordingly, a transfer structure 12 can be utilized which is negatively buoyant, especially when weighted by the chains 24** that is, a large float or buoyancy chamber does not have to be utilized.

The PDU 38 is a part of the system which normally requires considerable maintenance. Access to the PDU is enhanced by mounting it so it lies above the sea surface, which also protects the PDU from damage by waves and corrosion. The level of the sea surface changes with the amount of oil or other cargo stored in the vessel, with the line 50 indicating the relative water level at 100% ballast when the vessel 22 is filled with cargo, the line 52 indicating the water level at 60% ballast of the vessel, and the line 54 indicating the water level at 20% ballast. The vessel is always maintained above 20% ballast, since a lower level of ballast is dangerous in that it could result in capsizing of the vessel. In fact, where all of the cargo is to be pumped out, water is normally admitted to provide the necessary ballast. An average ballast condition is halfway between the safety borderline at 20% ballast and the maximum oil load at 100% ballast, which is the 60% ballast condition indicated by line 52. The description of the mooring terminal herein, refers to the 60% ballast condition where the condition is not otherwise described. Throughout the range of operation between the levels 50 and 54, the PDU 38 is above water level.

The system is designed to prevent the possibility that any of the catenary chains 24 will hit the bottom of the vessel 22, which could cause wear and possibly also damage to the hull. Although the chains normally extend in a primarily downward direction from the transfer structure, it is possible for them to extend at a relatively low incline, as when docking a tanker alongside the vessel 22, when forward surge of the vessel 22 may occur and a chain may extend at an incline of only about 30° from the horizontal. In one typical system, the chains normally extend from the transfer structure at a downward angle of about 50° to 60° from the horizontal under quiescent conditions. It is estimated that the chains will extend at an angle of about 35° from the horizontal perhaps once or twice a week during the life of the system, and that if the chains then struck the vessel they would abrade or otherwise damage it sufficiently in a few years to require repairs. It is also estimated that the chains would extend at an angle of about 30° perhaps once a year, and that it is unlikely there then would be damage or sufficient wearing to require repairs over the total life of perhaps 20 years of the installation. One design approach is to avoid the likelihood of any chain-to-vessel contact during the life of the installation.

To prevent interference between the chain and vessel, the transfer structure 12 is constructed with a considerable height, and with the lower end of the transfer structure substantially no higher than the bottom 22B of the vessel at the end nearest the transfer structure. The nonrotatable portion 30 of the transfer structure includes a platform or chain holder 56 at the bottom thereof, which is connected to the upper ends of the catenary lines 24. In the system of FIG. 3 the bottom of the platform 56 is slightly lower than the bottom 22B of the vessel end.

By locating the transfer structure 12 so its lower end is substantially no higher than the bottom of the adjacent vessel end, to avoid interference between the catenary chains and the vessel, it is possible to locate the transfer structure 12 very close to the vessel 22. As shown in FIG. 1, the distance S between the end of the vessel hull 22H and the transfer structure at the axis of rotation 28 thereof, is much less than the height H of the vessel, it preferably being less than half of the vessel height. This close mooring has several advantages, including the fact that the required bending strength of the mooring structure 26 is much less than would be required if the transfer structure were held a considerable distance away from the vessel, so that the cross sectional area and length of the mooring structure 26 are only moderate. The close proximity also somewhat reduces the amount of pitching motion of the transfer structure 12 which results when the vessel pitches, and also brings the PDU 38 closer to the vessel so access thereto is somewhat easier. In FIG. 1, a large vessel is shown, wherein the transfer structure 12 does not extend up to the upper deck of the vessel, and a staircase 60 and walkway 62 are provided to enable personnel to reach the PDU 38 for maintenance.

As discussed above, the considerable height of the transfer structure has the advantage of keeping the PDU 38 out of the water so it is easily accessible for maintenance while also keeping the lower end of the structure deeply enough submerged in the water to avoid interference between the catenary chains and the vessel. This construction also enables protection of the hose structure 14 from surface waves. The nonrotatable portion 30 of the transfer structure includes an elongated hollow riser frame or riser 70 having a height which is a plurality of times greater than its outside diameter, and the platform 56 is fixed to the lower end of the riser frame 70. By extending the upper ends of the hose structure 14 through the hollow riser frame 70, the upper end of the hose structure 14 is safeguarded from wave action. It may be noted that the upper end of the hose structure 14 may include rigid pipes, but their reliability is considerably enhanced by having them surrounded by the riser frame 70 at the location where they are subjected to surface waves.

The mooring structure 26 which holds the transfer structure 12 to the vessel, is formed to facilitate its construction and secure attachment to the complexly curved end of the vessel. As shown in FIG. 4, the mooring structure 26 is largely in the form of a box beam, and has upper and lower plates 74, 76 and a pair of side plates 78, 80. All of the plates have outer ends securely joined, as by welding, to the rotatable frame 32 of the transfer structure and have inner ends designed to be joined, as by welding, to the vessel 22. The inner ends **74*i*, 76*i* of the upper and lower plates, as well as of the side plates, are concavely curved to closely mate with the convex portion of the vessel end against which they lie and to which they are to be welded. The upper and lower plates can be initially formed with an approximate curvature to fit against vessels of approximate size, and actual mating can be accomplished by further cutting away of small portions of the plate inner ends to provide a good mating fit. As shown in FIG. 2, the upper and lower plates, which are each a plurality of times wider than their thickness, are designed to be mounted on the extreme end of the vessel, and to extend on either side of the longitudinal center plane 82 of the vessel. This construction of the mooring structure 26 enables a relatively short box beam structure to be utilized, which can be securely held to the vessel to support the transfer structure against large forces in all directions. The fact that the mooring structure 26 holds only a transfer structure portion that lies at a low level, and that is very close to the vessel, allows the mooring structure inner end 26*i*** to lie below water level at least at 60% vessel buoyancy, and actually at all safe buoyancy conditions from 20% to 100% buoyancy. This avoids the need for beams connected to the top and bottom of the hull that would be subjected to wave action and corrosion which would greatly increase the weight and cost of the structure.

It may be noted that the mooring structure 26 only attaches to the rotatable frame 32 which lies at the lower portion of the transfer structure. The rotatable portion 42 of the PDU 38 is separately connected to the vessel by the heavy duty pipe 44, so that the PDU is separately held to the vessel to rotate therewith. By vertically spacing the PDU from the rotatable frame 32 and separately connecting it to the vessel, the PDU is isolated from heavy forces that may be transmitted between the rotatable frame 32 and vessel and which could cause bending and damage to the PDU if allowed to pass therethrough.

Figure 5:
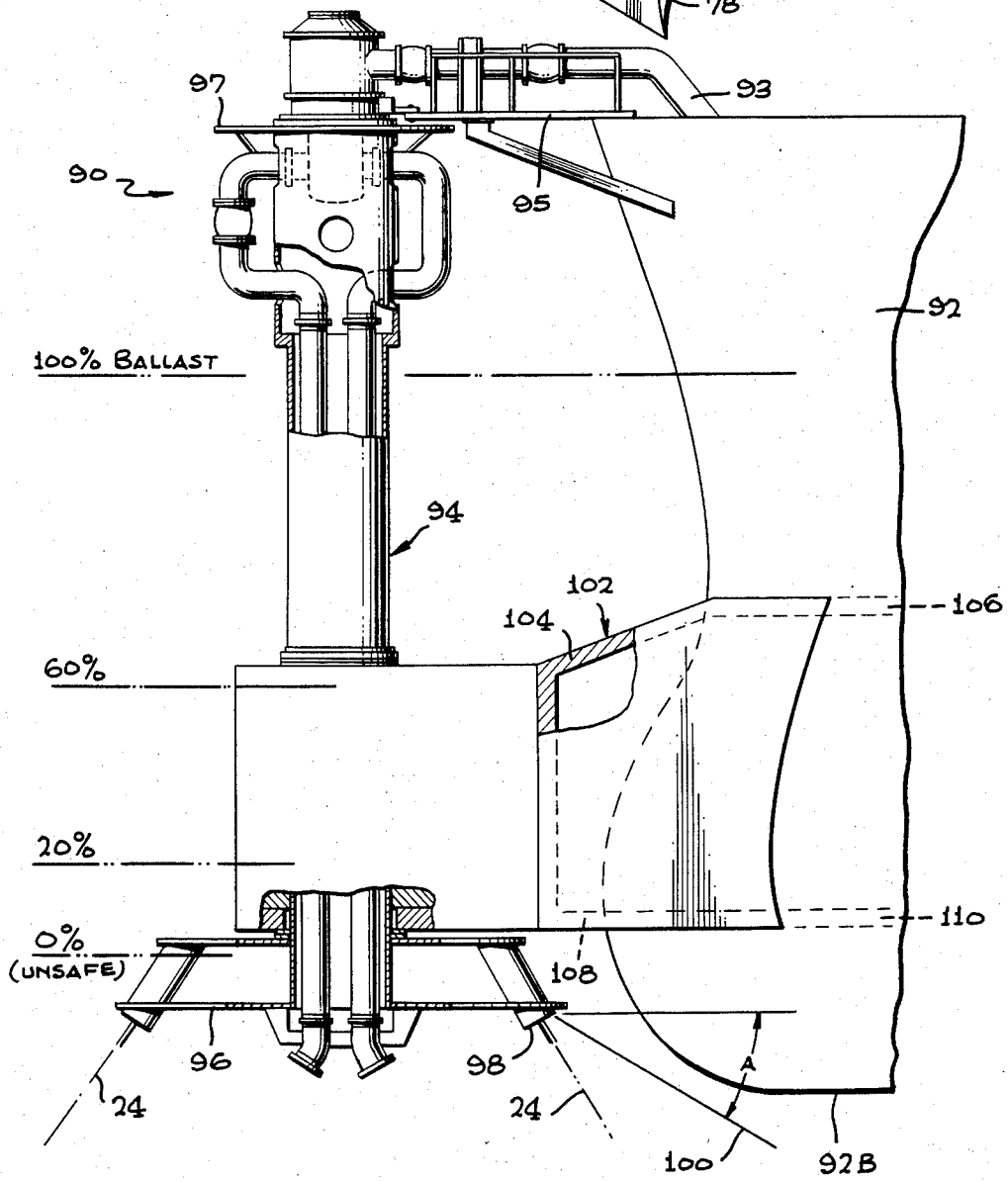
FIG. 5 is a partial side elevation view of an offshore terminal system constructed in accordance with another embodiment of the invention.

FIG. 5 illustrates an offshore terminal 90 which includes a somewhat smaller tanker vessel 92 and a transfer structure 94 which extends up to the upper deck of the vessel to facilitate maintenance and the connection of pipes 93 of the conduits that carry oil from the seabed to the vessel. A walkway 95 extends from the vessel to the transfer structure, and leads to a circular walkway 97 that is fixed to the nonrotatable portion of the transfer structure. The transfer structure 94 is similar to the transfer structure 12 of FIG. 3. However, a platform 96 at the bottom of the transfer structure, which connects to chains 24 extending down to the sea bottom, lies at a height slightly above the bottom 92B of the adjacent bow end of the vessel. As mentioned above, the catenary chains such as 24 normally do not extend at an angle A of less than about 30° from the horizontal even during forward surge of the vessel. Thus, by locating the portion 98 of the transfer structure which holds the chain 24, so that portion 98 is at a level at which an imaginary line 100 extending at a downward angle of 30° lies below the vessel bottom 92B, interference between the chains 24 and the vessel is avoided. The mooring structure 102 which connects the transfer structure to the vessel, is positioned so that the upper plate 104 thereof is welded to the vessel hull at the same level as a deck 106 of the vessel. The lower plate 108 of the mooring structure is similarly located so that it is at the same level as an internal bracing plate 110 of the vessel. This permits mooring loads to be transferred to braced locations on the vessel where the loads can be best withstood.

The offshore terminal can be constructed with many variations. While heavy chains extending in loose catenary curves are widely accepted to serve as the anchor lines that extend to the sea bed, it is possible to use light stretchable (e.g. Nylon) and largely taut lines. In another aspect of the invention, an advantage of using a trasfer structure fixed closely to a dedicated vessel is that the veseel (which would have considerable spare buoyancy), can support the transfer structure and the weight of heavy chains that anchor it. It should be noted, however, that the transfer structure itself may be constructed to be somewhat positively buoyant. In still another aspect of the invention, the hose structure or flexible conduit, which extends from the sea bed to the transfer structure can include a long length of flexible pipe which has less flexibility than a common hose, but may be of lower cost. It is even possible to use pivotally connected lengths of hard pipe between the sea floor and the transfer structure. In still another aspect of the invention, it is noted that it is possible to mount the PDU, or fluid swivel, or an overhanging beam extending from the ship, by mounting the rotatable portion of the PDU to the ship and coupling the nonrotatable portion of the PDU to the nonrotatable portion of the PDU to prevent relative rotation.

Thus, the invention provides an offshore terminal of the type which includes a transfer structure rigidly moored to an end of the vessel, wherein a relatively small and easily attached mooring structure can be utilized to hold the transfer structure to a dedicated vessel, and good protection is provided for the conduit that extends from the sea bottom to the vessel by way of the transfer structure. This is accomplished by utilizing a transfer structure which is held close to the vessel end such as within a distance less than the height of the vessel hull, and by mounting the transfer structure so its lower end is substantially no higher than the bottom of the adjacent vessel end to prevent interference between a catenary chain and the vessel. The flexible underwater conduit, which may include a hose or a moderately flexible pipe along most of its length, and which also may include lengths of hard piping, includes a length that extends through a hollow portion of the transfer structure which extends from below the water surface to above it, to protect the conduit from surface wave action. The mooring structure can include upper and lower plates with inner ends curved to mate with the vessel, and which are attached to the extreme end of the vessel.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An offshore terminal for connection to a pipeline lying at or near the sea floor, comprising:

a vessel which is seaworthy and which has at least one end which is convex, said vessel having a large positive buoyancy;

a negatively buoyant transfer structure lying at the sea surface, outboard of said vessel, said transfer structure having a nonrotatable portion of a height which is much less than the depth of the sea thereat, a rotatable portion, and bearings rotatably connecting said portions to permit rotation of the rotatable portion about a substantially vertical axis with respect to the nonrotatable portion while substantially preventing relative vertical movement of said portions;

at least one flexible line having an upper end connected to the nonrotatable portion of the transfer structure and a lower end anchored to the sea floor;

a fluid conduit means extending upwardly from said pipeline near the sea floor through said transfer structure to said vessel, for carrying fluid between them; and a mooring structure having an outer end lying beyond said convex end of the vessel as seen in a side elevation view of the vessel, said outer end rigidly fixed to said rotatable portion of said transfer structure and said structure having an opposite inner end fixed to said vessel, said mooring structure holding said transfer structure so that said vertical axis is closer to the nearest vessel end than the height of the vessel, and at a level wherein the lowest point where said flexible line is held by said structure, lies at an underwater level at which an imaginary line extending at a 30° downward incline therefrom towards said vessel does not intersect said vessel.

* * * * *